US005702204A

United States Patent [19]

Gunter

[11] Patent Number: 5,702,204

[45] Date of Patent: Dec. 30, 1997

[54] APPARATUS FOR CONNECTING AND ALIGNING FRAME MEMBER SECTIONS OF A TRENCH

[75] Inventor: Charles E. Gunter, Mooresville, N.C.

[73] Assignee: ABT, Inc., Troutman, N.C.

[21] Appl. No.: 620,871

[22] Filed: Mar. 22, 1996

[51] Int. Cl.[6] ..... E02B 5/00

[52] U.S. Cl. ..... 405/119; 404/2; 404/4; 405/118

[58] Field of Search ..... 405/118, 119, 405/120, 121; 404/2–4, 25, 26; 249/9–13

[56] References Cited

U.S. PATENT DOCUMENTS

| | | |
|---|---|---|
| 786,305 | 4/1905 | McIntyre . |
| 1,562,780 | 11/1925 | Mickelson . |
| 2,938,437 | 5/1960 | Daley . |
| 3,212,267 | 10/1965 | Biehn . |
| 3,299,785 | 1/1967 | James . |
| 3,625,011 | 12/1971 | Stevenson . |
| 3,797,188 | 3/1974 | Mansfeld . |
| 4,472,078 | 9/1984 | Karbstein . |
| 4,498,807 | 2/1985 | Kirkpatrick et al. . |
| 4,515,498 | 5/1985 | Thomann et al. . |
| 4,553,874 | 11/1985 | Thomann et al. . |
| 4,621,939 | 11/1986 | Thomann et al. . |
| 4,751,945 | 6/1988 | Williams . |
| 4,787,773 | 11/1988 | Kehler . |
| 4,844,655 | 7/1989 | Aleshire . |
| 4,993,877 | 2/1991 | Beamer . |
| 4,993,878 | 2/1991 | Beamer . |
| 5,000,621 | 3/1991 | Beamer . |
| 5,066,165 | 11/1991 | Wofford et al. . |
| 5,106,231 | 4/1992 | Thomann . |
| 5,256,000 | 10/1993 | Beamer . |
| 5,281,051 | 1/1994 | Stegall . |
| 5,281,052 | 1/1994 | Beamer . |
| 5,326,189 | 7/1994 | Beamer . |
| 5,326,190 | 7/1994 | Beamer . |
| 5,348,421 | 9/1994 | Stegall . |
| 5,393,171 | 2/1995 | Stegall . |
| 5,399,047 | 3/1995 | Stegall . |
| 5,478,169 | 12/1995 | Stegall . |

OTHER PUBLICATIONS

ABT, Inc., *Trench Former*, TF Jul. 1994.

MultiDrain Corporation, *EconoDrain*, 02725/MUN, BuyLine 7497.

ABT, Inc., *Trench Former System*, 1992.

MultiDrain Corporation, *EconoDrain*, 1992.

Neenah Foundary Company, *Main Office and Plants:*, 1996, pp. 262–263.

*Primary Examiner*—Dennis L. Taylor

*Attorney, Agent, or Firm*—The Bell Seltzer Intellectual Property Group of Alston & Bird

[57] ABSTRACT

An apparatus for connecting and aligning frame member sections of a trench with a connector is disclosed according to the present invention. The connector may include horizontal and vertical panel sections each defining a pair of openings therein. Protrusions extending from the ends of the adjacent frame member sections are inserted into the openings to securely connect the frame member sections together. The frame member sections may have a protrusion on both horizontal and vertical legs thereof and the connector may include a peripheral edge portion defining an edge of each of the openings and further defining a gap in the body portion. The gap allows the protrusion to be inserted in the opening. The peripheral edge portion may include a resilient end segment and a guide surface defined thereby for guiding the protrusion into the opening. The peripheral edge portion may also include a side segment defining a guide edge adjacent to the gap which is tapered to help guide the protrusion into the opening. A hinge member may also be provided between the horizontal and vertical panel sections to increase the resiliency of the connector.

46 Claims, 4 Drawing Sheets

APPARATUS FOR CONNECTING AND ALIGNING FRAME MEMBER SECTIONS OF A TRENCH

FIELD OF THE INVENTION

The invention relates to an apparatus for forming trenches. More particularly, the invention relates to an apparatus for connecting and aligning frame member sections of a trench.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. These trenches may also be used as utility chases to provide temporary or permanent routing of electrical lines, etc. below the level of the building floor. In addition, numerous outdoor industrial and commercial sites, such as parking lots, require drainage systems, including trenches, to collect and direct rainwater and other liquids to underground storm sewers to prevent flooding and to decrease runoff.

In the past, these trenches have generally been formed by first placing and securing a form of predetermined shape in a ditch which has previously been formed in the ground. A moldable trench forming composition, such as cement, concrete, or the like is then poured around the form and is allowed to set. Once the concrete has set, the form is removed from the resulting trench.

One common type of form assembly used to define a trench includes a wooden frame and strut structure. The wooden form includes a wooden frame which is covered with wooden sheets or planks to define a generally rectangular elongate trough. The wooden form is typically enclosed along its side and bottom faces, but may have an open top. Typically, a number of supporting wooden ribs are installed within the wooden form to increase the strength of the form so that it can withstand the relatively large pressures exerted by moldable trench forming compositions poured about it.

The wooden form is placed and secured within a preformed ditch. Concrete is typically poured up to the bottom face of the form and allowed to set. Then additional concrete is poured between the earthen walls of the ditch and the wooden sides of the form. Once all of the concrete has set, the wooden form is disassembled and removed from the trench.

Wooden forms are generally formed of lumber having a relatively rough exterior texture. Correspondingly, the inside surface of the trench formed by the wooden form is relatively uneven which reduces the efficiency of the flow of liquid through the trench. In addition, the assembly and disassembly of the wooden forms is both costly and labor intensive. The relatively large cost and labor required for assembly and disassembly of the wooden forms is increased in the formation of long trenches, and even further increased in the formation of trenches having a pitched or slanted bottom surface to facilitate drainage.

It is normally desirable to finish the trench with a trench cover, such as an elongate grate covering its open top, in order to prevent people from unwittingly stepping in the open trench, to provide a smooth surface for vehicle travel, and/or to prevent relatively large objects from entering the trench and potentially blocking the flow of liquid therethrough. The trench cover is generally supported by a pair of spaced apart frame members which are set into and extend from the walls of the concrete trench. In order to stabilize the trench cover and to prevent the trench cover from rocking when weight, such as from a passing vehicle, is applied thereto, the frame members must be aligned in a common plane during the pouring and setting of the concrete about the form. If the trench cover is not properly aligned, the trench cover, the frame members and/or the concrete trench itself may be damaged by the resulting movement of the trench cover. If the trench cover rocks excessively, the trench cover may even be dislodged from the frame members thus leaving the trench exposed. Accordingly, the alignment of the frame members in the moldable trench forming composition is both important and laborious.

In an attempt to properly align the frame members without laborious manual alignment, precast trench assemblies have been developed which include precast support surfaces for supporting a trench cover. Precast trench assemblies generally include preformed metal and/or plastic assemblies designed to be placed in a preformed ditch. Moldable trench forming composition may thereafter be poured about the precast trench assembly. Once the trench forming composition has set, the precast trench assembly is securely bonded to the trench forming composition to stabilize and support the precast trench assembly. Precast trench assemblies, however, are relatively expensive and may only be used once.

Commercially significant methods and apparatus for forming trenches, together with improved removable forms for forming trenches, are disclosed in U.S. Pat. No. 5,281,051 to Stegall which overcome a number of deficiencies of prior trench forming systems. In advantageous embodiments thereof, inexpensive forms are employed to form trenches having properly aligned frame members. The trench forming assembly disclosed in U.S. Pat. No. 5,281,051 preferably includes longitudinal frame members having a plurality of anchoring legs extending downwardly from the frame members. An elongate form body, preferably formed of relatively lightweight expanded polystyrene, preferably includes aligned longitudinal slots in the opposed sidewalls for receiving the frame members. Horizontal portions of the frame members are secured within the longitudinal slots in the sidewalls of the form body during formation of the trench so that the frame members are held in alignment during the trench forming operation.

Preferably, the assembled form and frame members are placed into a prepared ditch by suspending the assembly from its top. Concrete is then typically poured around the bottom of the anchoring legs attached to the frame members and allowed to set. Then concrete, or other trench forming composition, is poured around the form body and allowed to set. Finally the form body is removed to expose the resulting trench and the properly aligned frame members.

When forming trenches of extended length, the form body and frame members are typically made up of a series of sections arranged in an end-to-end relationship. The form body and frame member sections are typically manufactured in two, three, four, six and eight feet lengths. The form body sections may be sequenced with gradually increasing depth so as to enhance drainage therethrough while maintaining the trench cover at a uniform horizontal level. Thus, when arranging the frame member sections, they should be properly connected and aligned with the adjacent frame member sections.

In particular, it is important to connect the adjacent frame member sections before any concrete is poured so that the frame member sections will not separate when the subslab or trench walls are formed. If the gap between adjacent frame member sections becomes too large, the trench cover may not be properly supported. In addition, as discussed above, proper horizontal and vertical frame member alignment is important between adjacent sections to ensure that the trench cover is properly seated once the trench has been completed. Furthermore, any improvements in the degree of alignment of adjacent frame member sections can be very beneficial, even if the sections are sufficiently aligned to support a conventional trench cover, because more precise alignment allows, for example, the use of trench covers having tighter dimensional tolerances, which can be preferable in certain instances.

In conventional trench forming systems, adjacent frame member sections typically have been aligned visually, and then connected by way of one or more tie wires wrapped around the anchoring legs closest to the ends of the frame member sections. Such a procedure cannot only be laborious and time-consuming, but may not result in the optimal finished alignment if the frame member sections are not properly aligned initially, or if they shift as the concrete is poured.

It is sometimes necessary to disconnect and/or reconnect adjacent frame member sections after they have been arranged but before the concrete has been poured. For example, mistakes in the direction of flow or the overall layout of the trench can be made, or further excavation may be necessary underneath or adjacent to the assembled trench forming assembly. In such situations, it is desirable that the adjacent frame member sections can be disconnected and readily reconnected with the same aligned and secure connections as previously used.

Thus, there is a need for an apparatus which provides a secure connection between adjacent frame member sections and which prevents their inadvertent separation and shifting. In addition, there is a need for an apparatus which provides for improvements in the accuracy of alignment of adjacent frame member sections but which does not entail large amounts of labor or assembly difficulty. Such preferable alignment and connection attributes would be highly advantageous if combined in one such apparatus which is relatively simple to install. Moreover, such an apparatus would be even more advantageous if it were reusable so as to allow consistent and secure connection and reconnection of adjacent frame member sections.

SUMMARY OF THE INVENTION

The present invention meets the above and other needs by the provision of an improved trench forming apparatus. In one aspect, the invention provides a trench forming system including a connector for securely connecting adjacent ends of frame member sections of a trench forming system. In another aspect, a preferred connector is provided for connecting and aligning the adjacent frame member sections. The connector according to the present invention is also advantageously reusable.

The present invention relates to a trench forming system for forming a trench of predetermined shape and includes a pair of opposed and generally parallel and horizontal frame members for supporting a trench cover. Each of the frame members includes a plurality of elongate frame member sections arranged in an end-to-end relationship. Each of the frame members is provided with at least one, and more preferably two, outwardly extending protrusions adjacent to each of the ends of that frame member section.

An elongate form body is provided between the frame members and substantially defines the predetermined shape of the trench. The elongate form body, which may be formed of expanded polystyrene, includes a pair of opposed side surfaces and each of the frame members is engaged with a different one of the opposed side surfaces, typically along substantially the entire length of the form body. The trench forming system can also include at least one pair of downwardly extending legs connected to and supporting the frame members.

One advantageous aspect of the present invention is a connector for connecting and aligning the adjacent ends of the frame member sections. The connector, which may be formed of steel, includes at least one panel section having opposed ends and defining a pair of openings therein. Each of the openings is adjacent to a respective end of the connector.

Each of the protrusions of the adjacent frame member sections is inserted into and extends through one of the openings such that the frame member sections are securely interconnected and aligned in an end-to-end relationship. The connector thus ensures that the adjacent frame member sections will not be separated when the concrete is being poured below and around the form body.

The connector preferably includes a peripheral edge portion which at least partially defines a respective opening. The peripheral edge portion also defines a gap which divides the peripheral edge portion and which opens into the respective opening. Accordingly, a protrusion may be moved into an opening through the respective gap.

The peripheral edge portion also defines a guide surface adjacent to the gap for guiding the protrusion through the gap and into the opening. The guide surface extends outwardly in a direction away from the frame member section. In particular, the guide surface defines a guide surface plane which defines an included angle with a reference plane of the panel section of preferably less than 45°.

The connector is sufficiently resilient to deflect outwardly from an initial position as the protrusion of the respective frame member section is moved along the guide surface and through the gap. In addition, the connector is sufficiently resilient to substantially return to its initial position once the respective protrusion has been received within the opening. As such, the connector receives and securely holds the protrusion within the opening of the connector without any substantial permanent deformation of the connector.

A preferred frame member section includes a horizontal leg for supporting a trench cover and a vertical leg. Each of the horizontal and vertical legs may include an outwardly extending protrusion adjacent to the ends of each section. In such situations, a connector is provided which advantageously includes horizontal and vertical panel sections defining an included angle. The included angle between the panel sections of the connector is preferably between about 85° and 90° inclusive, and is more preferably about 89° to ensure a snug fit with the frame member sections.

The connector also advantageously includes a hinge member interconnecting the horizontal and vertical panel sections. The hinge member has a length less than that of the horizontal and vertical panel sections. As such, the end portions of the horizontal and vertical panel sections are substantially free to elastically deform outwardly as the protrusions are inserted in the respective openings. The horizontal and vertical panel sections may also define a recess adjacent to the hinge member to permit additional elastic deformation of the horizontal and vertical panel sections.

The peripheral edge portion may further include an end segment immediately adjacent to the respective end of the connector. The end segment is bent along a bend line to define the upturned guide surface. The end segment may have a predetermined width at least as great as the predetermined width of the adjacent opening such that the end segment is adapted to elastically deform outwardly as the protrusion of the frame member section is guided through the gap and into the opening.

The peripheral edge portion may further include a side segment defining a guide edge for guiding the protrusion through the gap and into the opening. The side segment may also define an engagement edge, defining an angle of less than 180° with the guide edge, to securely seat behind the outwardly extending protrusion. The protrusion may be in the form of a cleat having a predetermined thickness and the gap expands to a width greater than the thickness when the protrusion is passed therethrough.

Thus, a trench forming system is provided wherein adjacent frame member sections can be securely connected and precisely aligned prior to pouring the supporting concrete. The advantageous connector of the present invention securely connects the adjacent frame member sections such that they cannot separate while the concrete is being poured. Moreover, the connector advantageously precisely aligns the adjacent frame member sections in both the horizontal and vertical planes as it is clipped onto the ends of the frame member sections. The connection and alignment of the frame member sections provided by the connector of the present invention thus provide a continuous and level support surface for ensuring the trench cover will be securely seated once the concrete has been poured.

The connector also avoids the laborious and time consuming task of wire-tying the frame members which is required with conventional trench forming systems. In addition, the resilient nature of the connector according to the present invention provides more precise alignment and allows it to be removed from the frame member sections and reused if necessary while retaining its advantageous properties. The apparatus of the present invention thus provides a highly improved manner of connecting and aligning the adjacent frame member sections of a trench forming assembly.

BRIEF DESCRIPTION OF THE DRAWINGS

In the drawings which form a portion of the original disclosure of the invention, and which are not necessarily drawn to scale:

FIGS. 8–10 are a sequence of views illustrating the alignment and connection of the frame member sections according to the present invention and wherein;

DETAILED DESCRIPTION OF THE PREFERRED EMBODIMENTS

Figure 1:
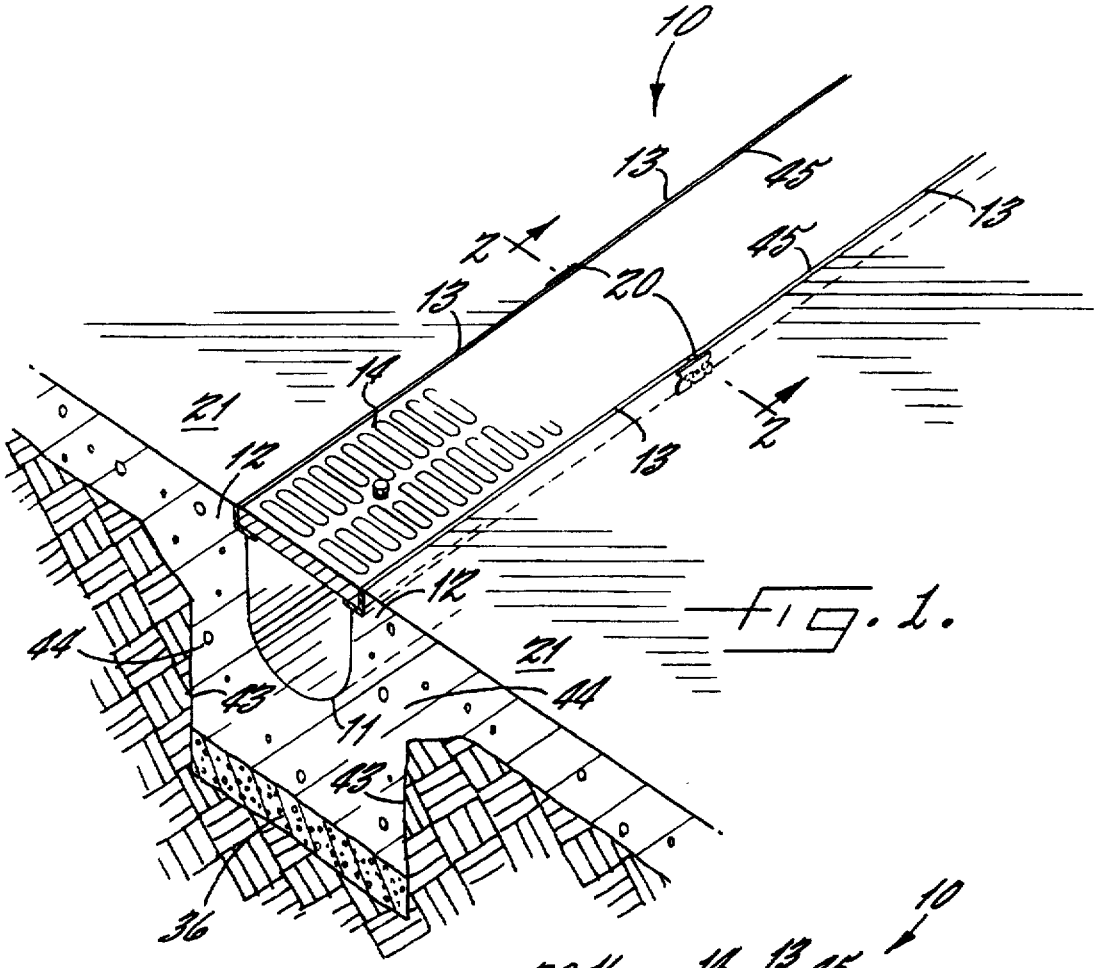
FIG. 1 is a perspective view of a preferred trench according to the present invention.

Various methods and apparatus embodiments of the invention are set forth below. While the invention is described with reference to specific preferred methods and apparatus including those illustrated in the drawings, it will be understood that the invention is not intended to be so limited. To the contrary, the invention includes numerous alternatives, modifications and equivalents as will become apparent from consideration of the present specification including the drawings, the foregoing discussion, and the following detailed description.

Figure 2:
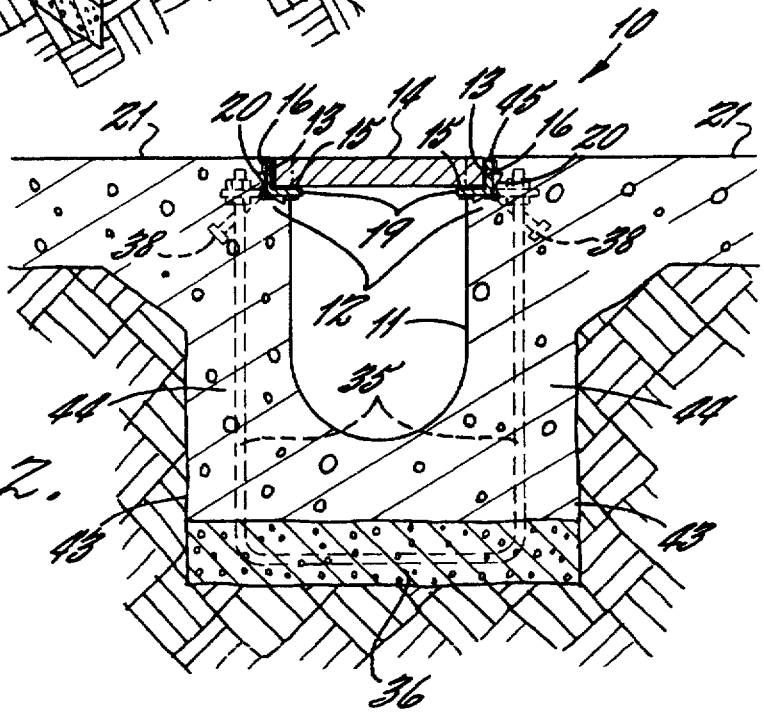
FIG. 2 is a sectional view of the trench of FIG. 1 illustrating the position of a pair of opposed frame members and taken along line 2—2 of FIG. 1.

A trench 10 according to the present invention is illustrated in FIGS. 1 and 2. The trench 10 includes a longitudinally extending channel portion 11 formed of a hardened trench forming composition as discussed below. The channel portion 11 defines an upwardly facing inner contour having a pair of opposed upper edges 12. When the trench 10 is to be used for transporting liquids, the depth of the trench may increase along the length of the trench so as to encourage proper liquid flow therethrough. A catch basin may be provided adjacent the deepest end of the trench 10 to collect liquids from the trench. In addition, the bottom of the inner contour of the channel portion is preferably rounded so that the trench will have a self-cleaning effect, even at low flow rates, because the flow will be localized.

Each of the opposed upper edges 12 of the channel portion has a frame member 13 adjacent thereto for supporting a trench cover 14. The trench cover 14 may be slotted in the form of a grate, as shown in FIG. 1. The slots allow liquids to flow into the trench 10 but prevent large debris from entering the trench and blocking liquid flow therethrough. If the trench 10 is to be used as a utility chase, the slotted trench cover 14 may be replaced with a solid cover (not shown).

The frame members 13, when viewed in cross-section as in FIG. 2, include a horizontal leg 15 and a vertical leg 16 and may be formed of any strong material capable of supporting a trench cover 14, and any weight which may be applied thereto. Accordingly, the type of structural steel conventionally referred to as "angle iron" is a preferred type of frame member 13. The ends of the frame member 13 are provided with at least one protrusion 17 extending outwardly therefrom. As discussed more fully below, these protrusions 17 are inserted into a connector 20 to securely connect adjacent frame member sections 13.

The horizontal legs 15 provide a pair of supporting surfaces for supporting the weight of the trench cover 14, and the vertical legs 16 center the trench cover over the trench 10. The vertical legs 16 preferably correspond in height to that of the trench cover 14, as can be seen in FIG. 2, such that the top of the trench cover lies in the same horizontal plane as the surrounding floor 21.

Although the frame members 13 are illustrated in the form of conventional angle iron, it is to be understood that the invention is not so limited. For example, the frame members 13 may take various forms such as a single horizontal or vertical strip, or more complex forms as described and illustrated in U.S. Pat. No. 5,478,169 to Stegall, which is incorporated herein by reference.

Figure 3:
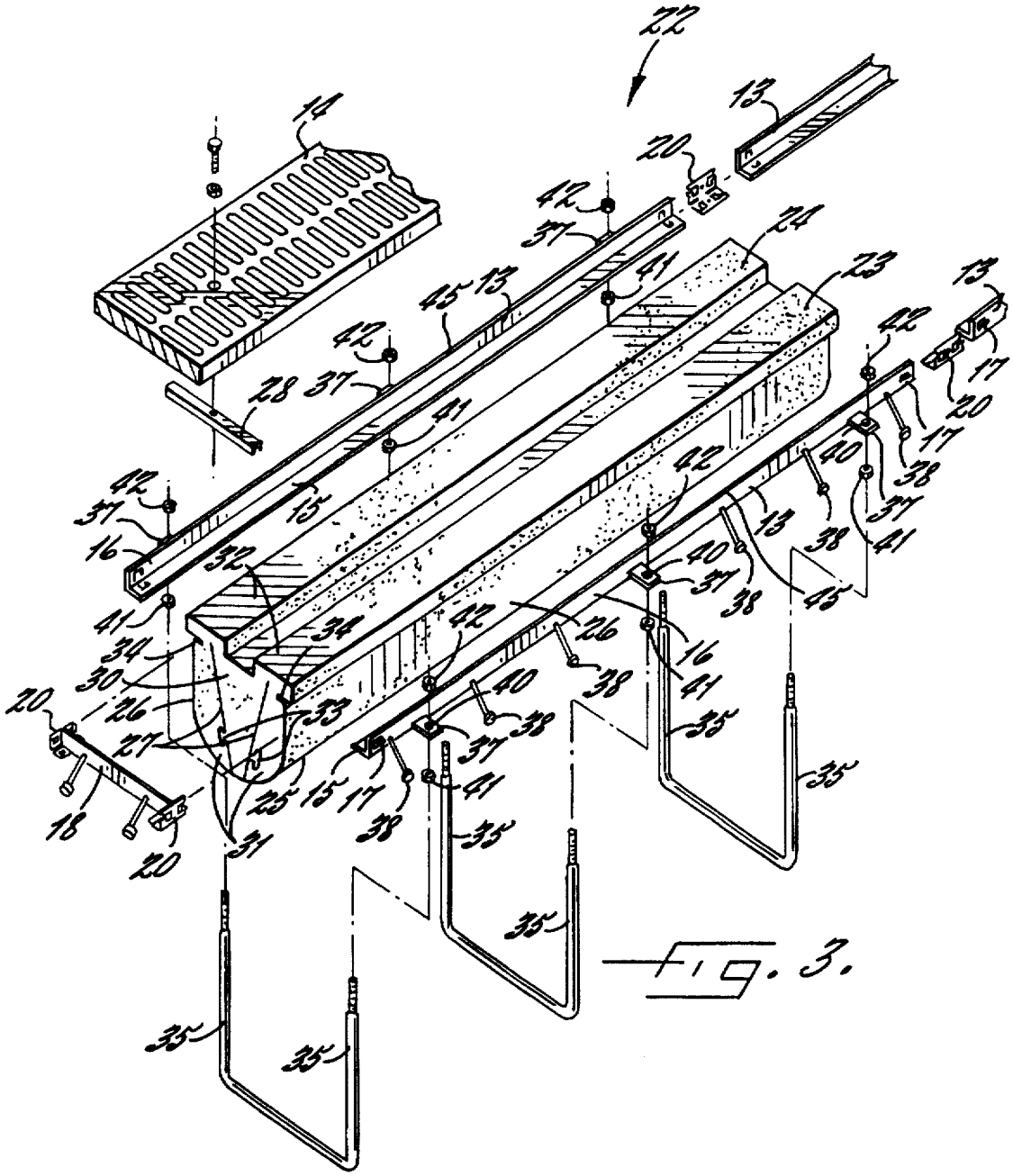
FIG. 3 is an exploded perspective view of a preferred embodiment of a trench forming system according to the present invention.
Figure 4:
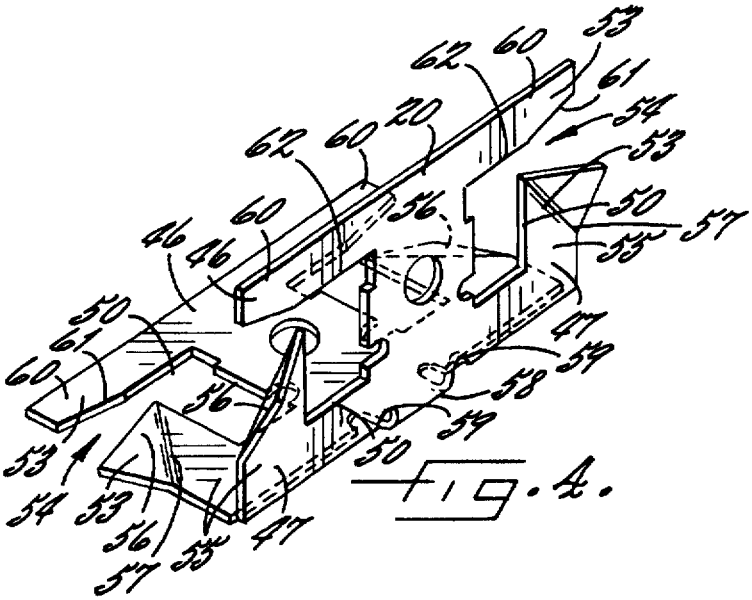
FIG. 4 is a greatly enlarged perspective view of a preferred embodiment of a connector according to the present invention.
Figure 5:
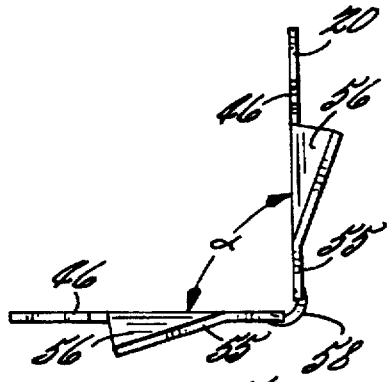
FIG. 5 is an end view of the connector illustrated in FIG. 4.

FIG. 3 illustrates an assembly 22 for forming a trench of predetermined shape according to the present invention. The trench forming assembly 22 includes the pair of frame members 13 and may further include an end rail 18 connecting the frame members at one end thereof. The end rail 18 may include a pair of connectors 20 according to the present invention attached thereto. Similarly, when connecting the frame member sections 13 to a cross rail, such as may be used when connecting to a catch basin, a connector comprising only one end or half of the connectors 20 according to the present invention, as will be apparent from the ensuing discussion, can be affixed to the cross rail to connect the frame member sections thereto.

An elongate form body 23 is held between the frame members 13. The elongate form body 23 includes a top surface 24, a bottom surface 25 and opposed side surfaces 26 for forming a moldable trench forming composition into the desired shape of the trench 10. The form body 23 is preferably made from an expanded plastic material such as expanded polystyrene. A form release agent may be applied to the surfaces of the form body 23 coming into contact with the trench forming composition so as to allow the form body to be more easily removed once the trench forming composition has hardened. A preferred release agent is a non-petroleum based product which does not chemically attack the form body 23.

One advantageous embodiment of the removable form 23 also includes a pair of form removal slots 27 extending upwardly into the form body from the bottom surface 25 thereof, as explained more fully in the previously incorporated by reference U.S. Pat. No. 5,478,169. The form removal slots 27 define, in transverse cross-section, an interiorally located and truncated V-shaped wedge portion 30 of the form body 23. The truncated V-shaped wedge portion 30 can be integrally joined to corresponding lateral portions 31 of the form body 23 by a pair of ear portions 32 of the form body adjacent its top surface 24 and a pair of fracturable locking members 33 extending into the lateral portions 31, as discussed in copending U.S. patent application Ser. No. 08/274,627 to Stegall filed Jul. 13, 1994, which is hereby incorporated by reference. This configuration is advantageous in the removal of the form body 23 from the channel portion 11 after the trench forming composition has hardened, as more fully discussed below.

The form body 23 also preferably includes a pair of frame member engagement slots 34 defined in the opposed side surfaces 26 of the form body. The engagement slots 34 are advantageously coplanar for receiving and maintaining the frame members 13 in a predetermined coplanar and spaced relationship above the bottom surface 25 of the form body 23. The frame member engagement slots 34 advantageously extend approximately ⅝" into the opposed side surfaces 26 and are preferably wide enough to accommodate the combined thicknesses of the horizontal leg 15 and connector 20. Since portions 19 of the horizontal legs 15 of the frame members are disposed within the respective frame member engagement slots 34, those portions advantageously overhang the upper edges 12 of the channel portion 11 to allow the removable engagement of a trench cover attachment mechanism 28.

The frame members 13 are preferably supported by at least one pair of anchoring legs 35 extending downwardly therefrom. These legs 35 are preferably formed from the type of reinforcing bar steel conventionally referred to as "rebar", but can be formed of other materials if desired. The legs 35 are adapted to anchor the form body 23 in a subslab 36 of moldable trench forming composition poured around the lower portion of each of the legs and below the bottom surface 25 of the form body 23, as can be seen in FIGS. 1 and 2. A plurality of anchoring studs 38 may also be attached to the frame members 13 to further secure them in the concrete.

In one advantageous embodiment, each of the legs 35 is generally U-shaped and is attached at an upper end portion thereof to the frame member section 13 in the manner disclosed in U.S. Pat. No. 5,399,047 to Stegall, which is incorporated herein by reference. As described therein, the frame member sections 13 include a plurality of laterally outwardly extending tabs 37 which are fixedly attached to the rear surface of the vertical leg 16 of the frame members 13, as shown in FIG. 3. The tabs 37 each include a bore 40 sized to receive a threaded end portion of an anchoring leg. A support member 41 is attached to the upper end of the anchoring leg 16 in order to support the bottom side of the tab 37 at a predetermined height along the anchoring leg. A nut 42 or like fastening member is provided for fastening onto the threaded end of the anchoring leg 16 to thereby secure the leg to the outwardly extending tab 37. Once assembled, the joined pair of anchoring legs 35 cooperate for engaging the frame members 13 with the side surfaces 26 of the form body 23.

The opposed pairs of anchoring legs 35 may be inwardly biased at their tops in order to enhance engagement of the frame members 13 with the slots 34 of the form body 23. This inward biasing can be accomplished by any of various means, such as by bending the upwardly extending legs 35 of the U-shaped members into a slightly acute angle.

Prior to assembly with the form body 23, the frame member 13 and anchoring structure is still relatively flexible so that the frame members can be easily moved with respect to each other, both outwardly and in a skewing motion. However, once the form body 23 has been engaged with the horizontal legs 16, the frame members are substantially secure against movement due to the geometry of the structure and the force applied to the frame members by the anchoring legs. One or more cords or wires (not shown) may be fastened around the form body 23 and the frame members 13 to secure the assembly 22.

In use, the elongate form assembly 22 is assembled in the manner described below, and is placed in a predetermined location, such as the preformed ditch 43 illustrated in FIG. 1. A plurality of batter boards (not shown) are preferably removably attached to the top surface 24 of the form body 23. The batter boards typically extend across the top surface 24 of the removable form 23 and can be affixed to the ground by means of wooden stakes or the like, so that the form assembly 22 is held or suspended in a fixed relation within the ditch 43.

The elongate form assembly 22 is thereafter anchored in the ditch 43 by pouring a subslab 36 of hardenable trench forming composition, such as concrete, in the ditch. The subslab 36 is poured about the lower end of the legs 35 and below the bottom surface 25 of the form body 23. Once the subslab 36 has hardened or set, the frame members 13 as well as the removable form 23, which is engagingly retained by the frame members, are held in a fixed relation within the ditch 43.

Subsequently, additional hardenable trench forming composition 44, which may also be concrete, is poured between the bottom 25 and opposed side 26 surfaces of the removable form 23 and the earthen walls of the ditch 43. As illustrated, the trench forming composition 44 preferably fills the ditch 43 about the form body 23 up to the upper edge 45 of the vertical leg 16 of the frame member 13. The connectors 20, which typically do not extend all the way to the upper edge 45 of the vertical leg 16, can thus be concealed after the trench forming composition 44 has been poured.

Once the hardenable trench forming composition 44 has hardened or set, the elongate form body 23 is removed. More particularly, the elongate form body 23 is removed by first removing the truncated V-shaped wedge portion 30 between the form removal slots 27 and then removing the corresponding lateral portions 31 of the form body. The truncated V-shaped wedge portion 30 is preferably removed by severing at least a portion of the top surface 24 of the form body 23 to remove the truncated V-shaped wedge portion 30 and then removing the corresponding lateral portions 31. The trench cover 14 may then be placed over the trench 10 on the frame members 13.

As discussed above, when forming trenches of extended length, the form body 23 and frame members 13 may comprise a series of sections arranged in an end-to-end relationship. The lowest or deepest section is preferably placed first, such as adjacent to a catch basin or other reference elevation. Sections of decreasing depth are then arranged sequentially proceeding from the first section. Even though the form body sections 13 may have differing depths, it is desirable to maintain adjacent frame member sections 13 in the same horizontal plane, such that the frame member can support a trench cover 14 in a predetermined level orientation, as can be seen in FIGS. 1, 2 and 3. Accordingly, a connector 20 is provided according to the present invention for connecting and aligning the adjacent frame member sections 13 before any concrete or trench forming composition is poured. The connector 20 also ensures that the adjacent frame member sections 13 do not separate or become misaligned during formation of either the subslab 36 or the trench walls 44.

A preferred embodiment of the connector 20 according to the present invention is illustrated in greater detail in FIGS. 4–7. The connector 20 includes at least one panel section 46 having opposed ends 47 and defining a pair of openings 50 adjacent to one of the opposed ends.

When the frame member sections 13 have horizontal 15 and vertical 16 legs connected at a right angle, as discussed above, the connector 20 may include a pair of substantially flat panel sections 46 each having a pair of openings 50 formed therein. The pair of panel sections 46 define an included angle $\alpha$ for being received against the legs 15,16 of a frame member section 13. The included angle $\alpha$ is preferably from about 85° to 90° inclusive, and is more preferably about 89°.

The connector 20 may be formed of any strong but resilient material. Sheet steel of 16 gauge or thinner is preferred, and 18 gauge steel is more preferred. The connector 20 may be formed by stamping a blank from the material and then performing subsequent bending operations to obtain the configuration illustrated in FIG. 4. In particular, several cutouts 51 may be included which are not critical to the operation of the invention but which make it easier to stamp and bend the connector 20 into the desired configuration without cracking the material.

The openings 50 are generally rectangular in shape and have a predetermined width and length sufficient to receive one of the protrusions 17 of the frame member sections 13, as discussed in more detail below. The protrusions 17 may be in the form of cleats lanced from the horizontal 15 and vertical 16 legs of the frame member sections 13. The cleats 17 have a predetermined thickness and each define an undercut portion 52, which is advantageous in aligning and securing the connector 20, as discussed below.

The illustrated connector 20 includes four peripheral edge portions 53 which each define an edge of one opening 50 adjacent to the respective end 47 of the connector. The peripheral edge portions 53 further each define a gap 54 for allowing a protrusion 17 to move through the gap and into the opening 50 when the connector 20 is pushed onto the end of a frame member section 13, as shown in FIGS. 8–10.

In particular, each peripheral edge portion 53 includes an end segment 55 immediately adjacent to the respective end 47 of the connector 20. The end segment 55 defines a guide surface 56 adjacent to the gap 54 for guiding the protrusion 17 through the gap and into the opening 50. The end segment 55 preferably has a predetermined width at least as great as the predetermined width of the adjacent opening 50.

Figure 6:
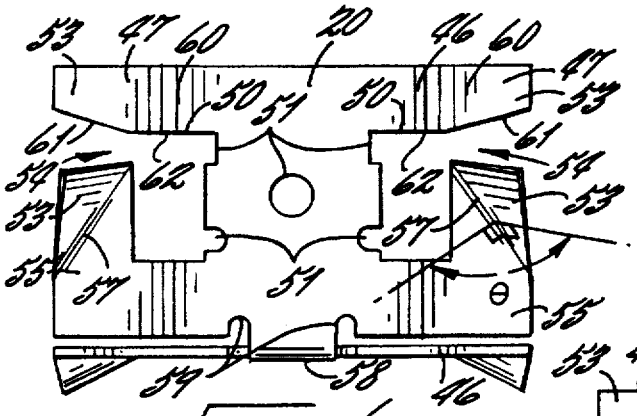
FIG. 6 is a side view of the connector illustrated in FIG. 4.
Figure 7:
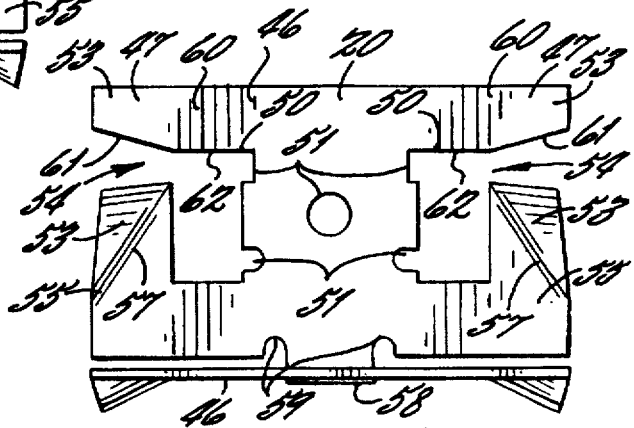
FIG. 7 is a bottom view of the connector illustrated in FIG. 4.

The guide surface 56 is bent outwardly so as to extend in a direction away from the frame member section 13. Preferably, a single bend line 57 is made at an approximately 45° angle relative to the end of the connector to form the guide surface 56. The guide surface 56 defines a guide surface plane which defines an included angle $\theta$ with a reference plane defined by the respective panel section 46, as shown in FIG. 6. The included angle $\theta$ is preferably less than 45°, and is more preferably about 34°.

The connector 20 is preferably sufficiently resilient so as to deflect outwardly from an initial position as the protrusion 17 is moved through the gap 54, and to then substantially return to the initial position once the protrusion is received within the opening 50 so as to securely hold the protrusion within the opening without any substantial permanent deformation, as discussed in more detail below.

The resiliency is advantageously improved by a hinge member 58 which interconnects the horizontal and vertical panel sections 46. The hinge member 58, which may comprise an outwardly rounded bend, as illustrated, has a predetermined length less than the predetermined length of the horizontal and vertical panel sections 46. This feature provides a relatively long lever arm which allows outward flexing and elastic deformation of the peripheral edge portion 53 and connector 20 when installing the connector over a protrusion 17. A pair of recesses 59 may be provided adjacent to the hinge member 58 to permit additional elastic deformation.

The peripheral edge portion 53 may also include a side segment 60 defining a compound inner edge having a guide edge 61 which at least partially defines the gap 54. The inner edge also includes an engagement edge 62 which at least partially defines the opening 50. The guide edge 61 is tapered so that the width of the gap widens in a direction towards the respective end 47 of the connector 20 and the guide edge 61 and engagement edge 62 thus define an angle of less than 180°. The guide edge 61 serves to align the connector 20 relative to the frame member section 13 when the protrusion 17 is guided through the gap 54 and into the opening 50. The engagement edge 62 securely seats behind the protrusion 17 to securely engage the protrusion within the opening.

Figure 8A:
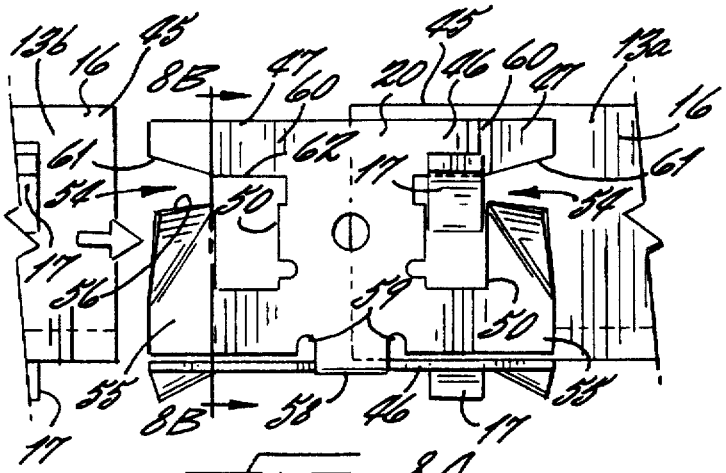
FIG. 8A is a side view of the connector prior to insertion of a protrusion of one of the frame member sections and FIG. 8B is a sectional view thereof taken along lines 8B—8B.
Figure 8B:
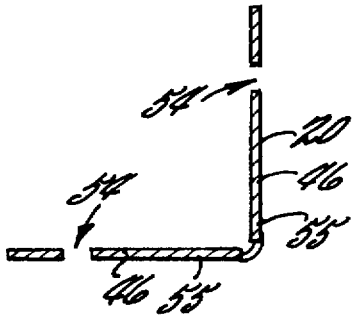

The connector 20 is installed according to the sequence shown in FIGS. 8–10. As illustrated in FIGS. 8A and 8B, the connector 20 is initially applied to the end of one of the frame member sections 13*a* in a manner which will become apparent from the discussion below.

Figure 9A:
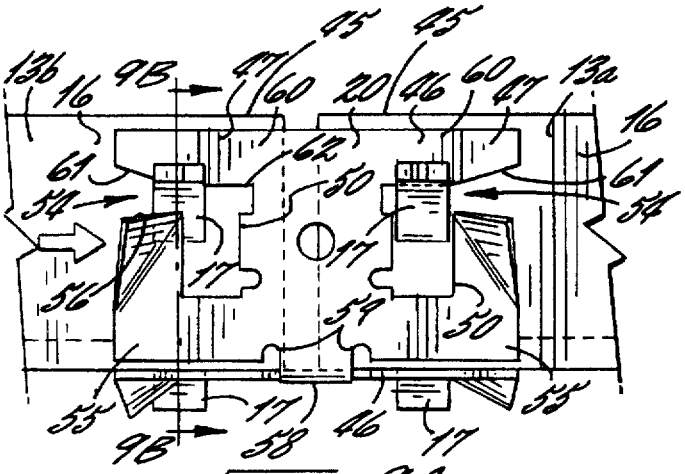
FIG. 9A is a side view of the connector when the protrusion has been partially inserted and FIG. 9B is a sectional view thereof taken along lines 9B—9B.
Figure 9B:
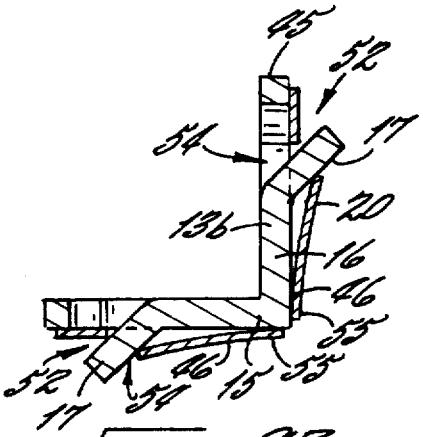

The other frame member section 13*b* is then moved in a direction parallel to the first frame member 13*a* section such that the respective protrusion 17 enters the gap defined by the peripheral edge portion 53, as illustrated in FIGS. 9A and 9B. The upturned guide surface 56 of the end segment 55 ensures that the protrusion 17 is easily and properly guided under the end segment. As can be seen in FIG. 9B, the end segment 55 is flexed outwardly from its initial position as the protrusion 17 is passed thereunder.

The tapered guide edge 61 of the side segment 60 guides the protrusion 17 into the opening 50 and aligns the connector 20 and frame member section 13 relative to each other as the protrusion is pushed into the opening. Because of both the horizontal 15 and vertical 16 legs of the frame member sections 13, the connector 20 and both adjacent frame member sections 13*a*,13*b* will be advantageously fully aligned in both the horizontal and vertical planes.

In addition, because the included angle $\alpha$ between the panel sections 46 of the connector 20 is preferably less than 90°, the panel sections may be flexed slightly outwardly towards 90° to conform to the frame member section 13 as the protrusions are aligned by the guide edges. This flexing of the resilient connector 20 advantageously provides a slight spring-load to the connector which ensures that the connector is drawn tight between the protrusions 17 and will not rattle or feel loose.

If the protrusions 17 are in the form of a cleat defining an undercut portion 52, as discussed above, the engagement edge 62 may extend into the undercut portion and thus at least part of the side segment 60 extends under the protrusion, as is illustrated in FIGS. 9 and 10. This feature is especially advantageous when connecting the illustrated frame member sections 13 because it provides that the connector 20 will be securely locked in place in all directions transverse to the frame member. In other words, the connector 20 can only be removed from a frame member section 13 (or placed thereon) in a direction parallel to the longitudinal axis of that frame member section. Accordingly, adjacent frame member sections 13 will be securely connected and not easily disengaged.

Figure 10A:
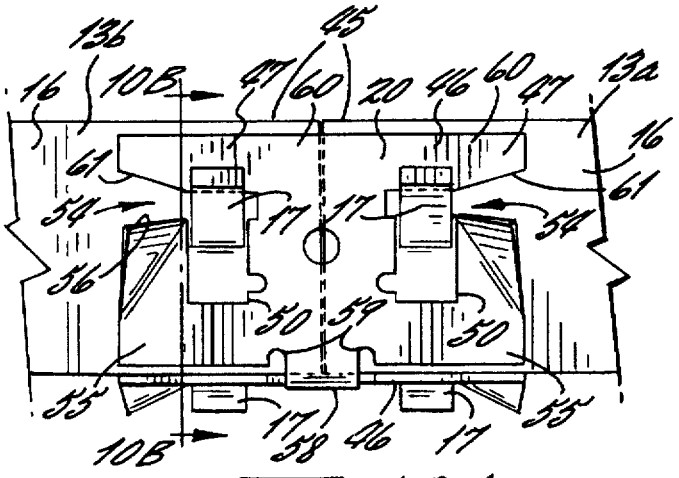
FIG. 10A is a side view of the connector and protrusion after the protrusion has been fully inserted and FIG. 10B is a sectional view thereof taken along lines 10B—10B.
Figure 10B:
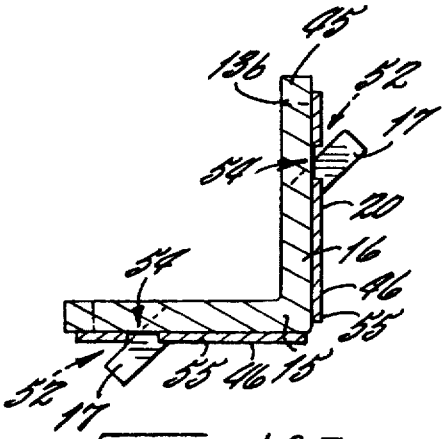

When the protrusion 17 is moved to its final position as illustrated in FIGS. 10A and 10B, it extends through the opening 50 and may partially extend over the panel section 46 of the connector 20. In addition, the resilient end segment 55 is allowed to snap back into place after the protrusion 17 has passed through the gap 54 and into the opening 50. The connector 20 thus acts like a clip and locks the protrusion 17 within the opening 50. Because the end segment 55 returns to its initial position, rather than being plastically deformed, the connector 20 provides improved alignment capabilities and allows the connector 20 to be reused if necessary.

The protrusions 17 are relatively easy to move through the gaps 54 and into the openings 50 because of the orientation of the guide surface 56 of the end segments 55, and thus the trench forming assembly 22 according to the present invention is easily assembled. Advantageously, however, the protrusions 17 are not removed from the openings 50 too easily, and thus the frame member sections 13 cannot be inadvertently pulled apart. If necessary, a connector 20 can be removed by prying a flat blade screwdriver or similar object under the guide surfaces 56 to flex the end segments 55 outwardly, thus allowing the protrusions 17 to be removed thereunder. Because of the resiliency of the connector 20, it does not become permanently deformed either when applied or when removed, and can thus be reapplied if desired.

The invention has been described in considerable detail with reference to preferred embodiments. However, many changes, variations, and modifications can be made without departing from the spirit and scope of the invention as described in the foregoing specification and defined in the appended claims. For example, the connector for adjacent frame member sections according to the present invention is not necessarily limited to applications relating to trenches and the like, but may also find application in other situations where frame or rail type members are to be connected and aligned. For example, the invention could relate to applications where protective rails are used at the corners of concrete structures to prevent chipping, etc., such as edge of a loading dock facility.

That which is claimed is:

1. A trench forming system for forming a trench of predetermined shape comprising:

a pair of opposed frame members defining a support surface for supporting a trench cover, said frame members comprising a plurality of elongate frame member sections arranged in an end-to-end relationship and having at least one outwardly extending protrusion adjacent to at least one of the ends thereof;

an elongate form body substantially defining said predetermined shape of said trench and comprising opposed side surfaces, each of said pair of frame members being engaged with a different one of said opposed side surfaces; and a connector for connecting the adjacent ends of said frame member sections, said connector comprising at least one panel section having opposed end portions and defining an opening within each respective end portion for engaging the respective protrusion of an adjacent frame member section such that said frame member sections are securely interconnected in an end-to-end relationship, wherein each end portion of said connector comprises a peripheral edge portion for at least partially defining the respective opening, said peripheral edge portion defining a gap which divides said peripheral edge portion and which opens into the respective opening, said peripheral edge portion defining a guide surface adjacent to the gap and extending outwardly in a direction away from said frame member section for guiding the protrusion through said gap and into said opening, wherein said connector is sufficiently resilient to deflect outwardly from an initial position as the protrusion of the respective frame member section is moved along the guide surface and through the gap, and wherein said connector is sufficiently resilient to substantially return to the initial position once the respective protrusion is received within the opening such that said connector receives and securely holds the protrusion within the opening of said connector without any substantial permanent deformation of said connector.

2. A trench forming system according to claim 1 wherein said panel section of said connector is formed of 16 gauge or thinner sheet steel.

3. A trench forming system according to claim 1 wherein each frame member section comprises a horizontal leg defining a support surface for supporting a trench cover and a vertical leg, wherein each of said horizontal and vertical legs of said frame member sections comprises an outwardly extending protrusion adjacent to at least one of the ends thereof, wherein said at least one panel section of said connector comprises horizontal and vertical panel sections of a predetermined length, wherein said connector further comprises a hinge member interconnecting said horizontal and vertical panel sections, and wherein said hinge member has a predetermined length less than the predetermined length of said horizontal and vertical panel sections such that the end portions of said horizontal and vertical panel sections are substantially free to elastically deform outwardly as the protrusion is inserted within a respective opening.

4. A trench forming system according to claim 3 wherein said horizontal and vertical panel sections define an included angle of between about 85° and about 90°.

5. A trench forming system according to 3 wherein each of said horizontal and vertical panel sections defines a recess portion adjacent said hinge member to permit additional elastic deformation of said horizontal and vertical panel sections as the protrusion is inserted within a respective opening.

6. A trench forming system according to claim 1 wherein said peripheral edge portion further comprises an end segment immediately adjacent the respective end of said connector, wherein said end segment is bent along a bend line to define said guide surface, wherein the guide surface defines a guide surface plane which defines an included angle of less than 45° with a reference plane defined by the one panel section, and wherein said end segment has a predetermined width at least as great as the predetermined width of the adjacent opening such that said end segment is adapted to elastically deform outwardly as the protrusion of the frame member section is guided through said gap and into said opening.

7. A trench forming system according to claim 1 wherein each outwardly extending protrusion has a predetermined thickness, and wherein said gap has a width greater than the predetermined thickness of a respective protrusion of an adjacent frame member section when said connector is deflected outwardly from the initial position such that the protrusion can pass through said gap and be engaged by said opening.

8. A trench forming system according to claim 1 wherein said peripheral edge portion further comprises a side segment defining a compound inner edge having a guide edge which at least partially defines said gap and an engagement edge which at least partially defines said opening, wherein said compound inner edge defines an angle of less than 180° between said guide edge and said engagement edge such that the width of said gap as defined by said guide edge widens in a direction toward the respective end of the connector to thereby guide the protrusion through said gap and into said opening and such that said engagement edge is adapted to securely seat behind the outwardly extending protrusion to thereby securely engage the protrusion within said opening.

9. A trench forming system according to claim 7 wherein each of said protrusions further comprises a cleat protruding from the frame member section, said cleat having said predetermined thickness and defining an undercut portion adjacent thereto.

10. A trench forming system according to claim 1 further comprising a pair of anchoring legs extending downwardly from respective ones of said opposed frame members.

11. A trench forming system according to claim 1 wherein said form body is made from an expanded plastic material.

12. A trench forming system according to claim 11 wherein said expanded plastic material is expanded polystyrene.

13. A trench forming system for forming a trench of predetermined shape comprising:

a pair of opposed frame members comprising a plurality of elongate sections arranged in an end-to-end relationship, wherein each frame member section comprises a horizontal leg defining a support surface for supporting a trench cover and a vertical leg, and wherein each of said horizontal and vertical legs of said frame member sections comprises an outwardly extending protrusion adjacent to at least one of the ends thereof;

an elongate form body substantially defining said predetermined shape of said trench and comprising opposed side surfaces, wherein each side surface defines a longitudinal slot for receiving a horizontal leg of a respective frame member section; and a connector for connecting the adjacent ends of said frame member sections, said connector comprising:

horizontal and vertical panel sections of a predetermined length, each panel section comprising opposed end portions and defining an opening within each respective end portion which is adapted to engage a protrusion of the respective leg of an adjacent frame member section such that the adjacent frame member sections can be securely interconnected; and a hinge member interconnecting said horizontal and vertical panel sections, wherein said hinge member has a predetermined length less than the predetermined length of said horizontal and vertical panel sections such that the end portions of said horizontal and vertical panel sections are substantially free to elastically deform outwardly as the protrusion of the respective leg of an adjacent frame member section is inserted within a respective opening.

14. A trench forming system according to claim 13 wherein said horizontal and vertical panel sections of said connector are formed of 16 gauge or thinner sheet steel which is sufficiently resilient to deflect outwardly from an initial position as the protrusion of the respective frame member section is inserted through the gap and to substantially return to the initial position once the respective protrusion is received within the opening such that said connector is adapted to receive and securely hold the protrusion within the opening of said connector without any substantial permanent deformation of said connector.

15. A trench forming system according to claim 13 wherein said horizontal and vertical panel sections define an included angle of between about 85° and about 90°.

16. A trench forming system according to claim 15 wherein said horizontal and vertical panel sections define an included angle is about 89°.

17. A trench forming system according to claim 13 wherein each of said horizontal and vertical panel sections defines a recess portion adjacent said hinge member to permit additional elastic deformation of said horizontal and vertical panel sections as the protrusion is inserted within a respective opening.

18. A trench forming system according to claim 13 wherein each end portion of said connector comprises a peripheral edge portion for at least partially defining the respective opening, said peripheral edge portion defining a gap which divides said peripheral edge portion and which opens into the respective opening.

19. A trench forming system according to claim 18 wherein each protrusion has a predetermined thickness, and wherein said gap has a width greater than the predetermined thickness of a respective protrusion of an adjacent frame member section when said connector is elastically deformed outwardly such that the protrusion can pass through said gap and be engaged by said opening.

20. A trench forming system according to claim 18 wherein said peripheral edge portion further comprises a side segment defining a compound inner edge having a guide edge which at least partially defines said gap and an engagement edge which at least partially defines said opening, wherein said compound inner edge defines an angle of less than 180° between said guide edge and said engagement edge such that the width of said gap as defined by said guide edge widens in a direction toward the respective end of the connector to thereby guide the protrusion through said gap and into said opening and such that said engagement edge is adapted to securely seat behind the outwardly extending protrusion to thereby securely engage the protrusion within said opening.

21. A trench forming system according to claim 18 wherein said peripheral edge portion further comprises an end segment immediately adjacent the respective end of said connector, wherein said end segment is bent along a bend line to define a guide surface adjacent to said gap and extending in a direction outwardly in a direction away from said frame member section for guiding the protrusion through said gap and into said opening, wherein the guide surface defines a guide surface plane which defines an included angle of less than 45° with a reference plane defined by the respective panel section, and wherein said end segment has a predetermined width at least as great as the predetermined width of the adjacent opening such that said end segment is adapted to elastically deform outwardly as the protrusion of the frame member section is guided through said gap and into said opening.

22. A trench forming system according to claim 19 wherein each of said protrusions further comprises a cleat protruding from the frame member section, said cleat having said predetermined thickness and defining an undercut portion adjacent thereto.

23. A trench forming system according to claim 13 further comprising a pair of anchoring legs extending downwardly from respective ones of said opposed frame members.

24. A trench forming system according to claim 13 wherein said form body is made from an expanded plastic material.

25. A connector for connecting adjacent frame member sections of a trench forming system wherein the frame member sections include an outwardly extending protrusion of a predetermined thickness adjacent to at least one of the ends thereof, said connector comprising:

at least one panel section having opposed end portions and defining an opening within each respective end portion which is adapted to engage the respective protrusion of an adjacent frame member section such that the adjacent frame member sections can be securely interconnected in an end-to-end relationship;

wherein each end portion of said connector comprises a peripheral edge portion for at least partially defining the respective opening, said peripheral edge portion defining a gap which divides said peripheral edge portion and which opens into the respective opening, said gap having a width greater than the predetermined thickness of the respective protrusion of an adjacent frame member section when the protrusion is passed through said gap so as to be engaged by said opening, and wherein said peripheral edge portion comprises a side segment defining a compound inner edge having a guide edge which at least partially defines said gap and an engagement edge which at least partially defines said opening, wherein said compound inner edge defines an angle of less than 180° between said guide edge and said engagement edge such that the width of said gap as defined by said guide edge widens in a direction toward the respective end of the connector to thereby guide the protrusion through said gap and into said opening and such that said engagement edge is adapted to securely seat behind the outwardly extending protrusion to thereby securely engage the protrusion within said opening.

26. A connector according to claim 25 wherein said panel section is formed of 16 gauge or thinner sheet steel which is sufficiently resilient to deflect outwardly from an initial position as the protrusion of the respective frame member section is inserted through the gap and to substantially return to the initial position once the respective protrusion is received within the opening such that said connector is adapted to receive and securely hold the protrusion within the opening of said connector without any substantial permanent deformation of said connector.

27. A connector according to claim 25 wherein said at least one panel section comprises horizontal and vertical panel sections of a predetermined length, and wherein said connector comprises a hinge member interconnecting said horizontal and vertical panel sections, wherein said hinge member has a predetermined length less than the predetermined length of said horizontal and vertical panel sections such that the end portions of said horizontal and vertical panel sections are substantially free to elastically deform outwardly as the protrusion is inserted within a respective opening.

28. A connector according to claim 27 wherein said horizontal and vertical panel sections define an included angle of between about 85° and about 90°.

29. A connector according to claim 27 wherein each of said horizontal and vertical panel sections defines a recess portion adjacent said hinge member to permit additional elastic deformation of said horizontal and vertical panel sections as the protrusion is inserted within a respective opening.

30. A connector according to claim 25 wherein said peripheral edge portion further comprises an end segment immediately adjacent the respective end of said connector, wherein said end segment is bent along a bend line to define a guide surface adjacent to said gap and extending in a direction outwardly in a direction away from said frame member section for guiding the protrusion through said gap and into said opening, wherein the guide surface defines a guide surface plane which defines an included angle of less than 45° with a reference plane defined by the one panel section, and wherein said end segment has a predetermined width at least as great as the predetermined width of the adjacent opening such that said end segment is adapted to elastically deform outwardly as the protrusion of the frame member section is guided through said gap and into said opening.

31. A connector for connecting and aligning adjacent frame member sections of a trench forming system wherein the frame member sections have vertical and horizontal legs and include an outwardly extending protrusion adjacent to at least one of the ends thereof, said connector comprising:

horizontal and vertical panel sections of a predetermined length, each panel section comprising opposed end portions and defining an opening within each respective end portion which is adapted to engage a protrusion of the respective leg of an adjacent frame member section such that the adjacent frame member sections can be securely interconnected; and a hinge member interconnecting said horizontal and vertical panel sections, wherein said hinge member has a predetermined length less than the predetermined length of said horizontal and vertical panel sections such that the end portions of said horizontal and vertical panel sections are substantially free to elastically deform outwardly as the protrusion of the respective leg of an adjacent frame member section is inserted within a respective opening.

32. A connector according to claim 31 wherein said horizontal and vertical panel sections are formed of 16 gauge or thinner sheet steel which is sufficiently resilient to deflect outwardly from an initial position as the protrusion of the respective frame member section is inserted through the gap and to substantially return to the initial position once the respective protrusion is received within the opening such that said connector is adapted to receive and securely hold the protrusion within the opening of said connector without any substantial permanent deformation of said connector.

33. A connector according to claim 31 wherein said horizontal and vertical panel sections define an included angle of between about 85° and about 90°.

34. A connector according to claim 33 wherein said horizontal and vertical panel sections define an included angle of about 89°.

35. A connector according to claim 31 wherein each of said horizontal and vertical panel sections defines a recess portion adjacent said hinge member to permit additional elastic deformation of said horizontal and vertical panel sections as the protrusion is inserted within a respective opening.

36. A connector according to claim 31 wherein each end portion of said connector comprises a peripheral edge portion for at least partially defining the respective opening, said peripheral edge portion defining a gap which divides said peripheral edge portion and which opens into the respective opening.

37. A connector according to claim 31 wherein said gap has a predetermined width greater than the predetermined thickness of a respective protrusion of an adjacent frame member section such that the protrusion can pass through said gap and be engaged by said opening.

38. A connector according to claim 36 wherein said peripheral edge portion further comprises a side segment defining a compound inner edge having a guide edge which at least partially defines said gap and an engagement edge which at least partially defines said opening, wherein said compound inner edge defines an angle of less than 180° between said guide edge and said engagement edge such that the width of said gap as defined by said guide edge widens in a direction toward the respective end of the connector to thereby guide the protrusion through said gap and into said opening and such that said engagement edge is adapted to securely seat behind the outwardly extending protrusion to thereby securely engage the protrusion within said opening.

39. A connector according to claim 36 wherein said peripheral edge portion comprises an end segment immediately adjacent the respective end of said connector, wherein said end segment is bent along a bend line to define a guide surface adjacent to said gap and extending in a direction outwardly in a direction away from said frame member section for guiding the protrusion through said gap and into said opening, wherein the guide surface defines a guide surface plane which defines an included angle of less than 45° with a reference plane defined by the respective panel section, and wherein said end segment has a predetermined width at least as great as the predetermined width of the adjacent opening such that said end segment is adapted to elastically deform outwardly as the protrusion of the frame member section is guided through said gap and into said opening.

40. A connector for connecting adjacent frame member sections of a trench forming system wherein the frame member sections include an outwardly extending protrusion of a predetermined thickness adjacent to at least one of the ends thereof, said connector comprising:

at least one panel section defining a reference plane and having opposed end portions, said panel section also defining an opening of predetermined width within each respective end portion which is adapted to engage the respective protrusion of an adjacent frame member section such that the adjacent frame member sections can be securely interconnected in an end-to-end relationship;

wherein each end portion of said connector comprises a peripheral edge portion for at least partially defining the respective opening, said peripheral edge portion defining a gap which divides said peripheral edge portion and which opens into the respective opening such that the protrusion can pass through said gap and be engaged by said opening, wherein said peripheral edge portion comprises an end segment immediately adjacent the respective end of said connector, wherein said end segment is bent along a bend line to define a guide surface adjacent to said gap and extending in a direction outwardly in a direction away from said frame member section for guiding the protrusion through said gap and into said opening, wherein the guide surface defines a guide surface plane which defines an included angle of less than 45° with a reference plane defined by the one panel section, and wherein said end segment has a predetermined width at least as great as the predetermined width of the adjacent opening such that said end segment is adapted to elastically deform outwardly as the protrusion of the frame member section is guided through said gap and into said opening.

41. A connector according to claim 40 wherein said panel section is formed of 16 gauge or thinner sheet steel which is sufficiently resilient to deflect outwardly from an initial position as the protrusion of the respective frame member section is inserted through the gap and to substantially return to the initial position once the respective protrusion is received within the opening such that said connector is adapted to receive and securely hold the protrusion within the opening of said connector without any substantial permanent deformation of said connector.

42. A connector according to claim 40 wherein said at least one panel section further comprises horizontal and vertical panel sections of a predetermined length, and wherein said connector comprises a hinge member interconnecting said horizontal and vertical panel sections, wherein said hinge member has a predetermined length less than the predetermined length of said horizontal and vertical panel sections such that the end portions of said horizontal and vertical panel sections are substantially free to elastically deform as the protrusion is inserted within a respective opening.

43. A connector according to claim 42 wherein said horizontal and vertical panel sections define an included angle of between about 85° and about 90°.

44. A connector according to claim 42 wherein each of said horizontal and vertical panel sections defines a recess portion adjacent said hinge member to permit additional elastic deformation of said horizontal and vertical panel sections as the protrusion is inserted within a respective opening.

45. A connector according to claim 40 wherein said gap has a predetermined width greater than the predetermined thickness of a respective protrusion of an adjacent frame member section when said end segment is elastically deformed outwardly such that the protrusion can pass through said gap and be engaged by said opening.

46. A connector according to claim 40 wherein said peripheral edge portion further comprises a side segment defining a compound inner edge having a guide edge which at least partially defines said gap and an engagement edge which at least partially defines said opening, wherein said compound inner edge defines an angle of less than 180° between said guide edge and said engagement edge such that the width of said gap as defined by said guide edge widens in a direction toward the respective end of the connector to thereby guide the protrusion through said gap and into said opening and such that said engagement edge is adapted to securely seat behind the outwardly extending protrusion to thereby securely engage the protrusion within said opening.

* * * * *